United States Patent [19]

Dittrich

[11] 4,300,314

[45] Nov. 17, 1981

[54] THRESHOLD WITH MAGNETIC WEATHER STRIPPING

[75] Inventor: Sebastian Dittrich, Clifton, N.J.

[73] Assignee: Magnetic Weather Stripping Corp., Clifton, N.J.

[21] Appl. No.: 87,021

[22] Filed: Oct. 22, 1979

[51] Int. Cl.[3] ..... F06B 1/70

[52] U.S. Cl. ..... 49/470

[58] Field of Search ..... 49/469, 470, 478

[56] References Cited

U.S. PATENT DOCUMENTS

| | | | |
|---|---|---|---|
| 1,795,853 | 3/1931 | Glass | 49/470 |
| 3,604,152 | 9/1971 | Protzman | 49/478 X |
| 4,192,101 | 3/1980 | White | 49/470 X |

*Primary Examiner*—Kenneth Downey

*Attorney, Agent, or Firm*—Siegmar Silber

[57] ABSTRACT

A threshold assembly for mounting on a door and a door sill is described which includes a threshold plate assembly formed of nonmagnetically attracted material and a door cap assembly for mounting on the bottom edge of the door. The threshold plate assembly has a first stepped portion with a substantially vertical face extending medially along the bottom edge of the door. This first stepped portion comprises: a riser portion and a stair portion extending from the lower edge of the riser portion inwardly toward and beyond the interior surface of a door. Second stepped portion on the bottom edge of a door includes the lowermost portion corresponding to stair portion of the first stepped portion and the uppermost portion corresponding to a saddle portion. A magnet mounting device for attachment to the lowermost portion of a second stepped portion includes: a slot extending substantially vertically adjacent the lowermost portion and a guard plate extending substantially horizontally adjacent the stair portion. A magnet holding assembly mounted to the magnet-mounting device that includes: a T-shaped mounting flange for mounting within a slot with the stem protruding therefrom; an extensible bellows attached at one end to the stem permitting the horizontally extending movement of the magnet assembly when magnetic attraction exists and horizontally retracting movement of the magnet assembly when magnet attraction ceases, and a pocket with one side attached at the other end of the extensible bellows.

10 Claims, 3 Drawing Figures

THRESHOLD WITH MAGNETIC WEATHER STRIPPING

BACKGROUND OF THE INVENTION

1. Field of the Invention

The present invention relates generally to an improved door sealing arrangement, and more particularly to an improved magnet-sealing device for thresholds to protect against heating and cooling energy losses and to reduce dust infiltration.

2. Description of the Prior Art

In the past, doors with magnetic stripping sealing have been developed and used especially for cabinets and refrigerators. In these applications, the doors open outwardly from the protected area so that the sealing arrangement is larger than the opening and in general is constructed to be continuous about the periphery of the door. More recently, because of energy considerations, magnetic sealing weatherstripping closures have seen increasing use in homes and particularly for exterior openings. As a result, various constructions of magnetic weather stripping and magnetic sealing doors have been proposed. By way of example, in the patent to Gregory, U.S. Pat. No. 2,611,158, a weatherstrip construction is taught wherein the metal weatherstrip is flexibly mounted on a fixed element which is provided with a hook. In the sealing mode of operation, the weatherstrip is rotated about the hook until the arcuate path of travel is further prevented by the rubber strip.

The threshold invented by Protzman, U.S. Pat. No. 3,604,152 shows a device with a ferrous strip incorporated therein to seal by magnetic attraction against a member carrying a magnet. It is interesting to note that the L-shaped channel causes the assembly to be somewhat skewed from vertical.

A review of the art shows that these threshold constructions would tend, within a relatively short period of time, to wear or to work fatique the vinyl extrusion that carries the magnet element. Further, limited attention is given to facilitation of removing and replacing of magnets and magnetic elements. The magnetic weatherstripped threshold construction of the invention is designed so that all parts of a magnetic sealing system are easily removed, cleaned and installed or replaced. Thus the invention is more adapted to the actual conditions in which a threshold works, namely dust, dirt, and repetitive exposure to door action and foot traffic.

SUMMARY OF THE INVENTION

According to the invention herein, there is described a threshold assembly for mounting on a door and a door sill. This assembly includes: a threshold plate formed of nonmagnetically attracted material that has a first stepped portion with a substantially vertical face extending medially along the bottom edge of the door. This first stepped portion comprises: a riser portion and a stair portion extending from the lower edge of the riser portion inwardly toward and beyond the interior surface of a door. A channel is positioned in the face of the riser portion. From the upper edge of the riser portion a saddle portion extends outwardly beyond the exterior surface of a door. The first stepped portion also has an attachment means for attaching this portion to the door sill. Second stepped portion on the bottom edge of a door includes the lowermost portion corresponding to stair portion of the first stepped portion and the uppermost portion corresponding to a saddle portion.

A magnet mounting device for attachment to the lowermost portion of a second stepped portion includes: a slot extending substantially vertically adjacent the lowermost portion and a guard plate extending substantially horizontally adjacent the stair portion. A magnet mounting device may also optionally include vertical stiffening markers to prevent inadvertent crimping of said guard plate.

A magnet holding assembly mounted to the magnet-mounting device that includes: a T-shaped mounting flange for mounting within a slot with the stem protruding therefrom a flange: extensible bellows attached at one end to the stem permitting the horizontally extending movement of the magnet assembly when magnetic attraction exists and horizontally retracting movement of the magnet assembly when magnet attraction ceases, and a pocket with one side attached at the other end of the extensible bellows

OBJECTS OF THE INVENTION

It is an object of this invention to provide an improved sealing arrangement for an access door, which is constructed and provided with magnetic edge seals.

It is also an object to provide special construction of a threshold which will allow one to remove and replace all parts of the magnetic sealing arrangement without removing the threshold plate.

A further object of the invention is the provision of a readily and easily installed threshold-doorsill assembly with a magnetic seal incorporated therein.

A further object of the invention is the effective sealing of an exterior door by use of magnetic weatherstripping in combination with the magnetic seal of the threshold assembly.

BRIEF DESCRIPTION OF THE DRAWINGS

With the above and additional objects and advantages in view as will hereinafter appear, this invention comprises the assembly, combinations and arrangements of parts hereinafter described and illustrated in the accompanying drawings of a preferred embodiment in which.

DESCRIPTION OF THE PREFERRED EMBODIMENT

For the purpose of this description the preferred embodiment is described in relationship to an inwardly opening exterior door. It is recognized that a practitioner can, within the state-of-the-art, apply the disclosed invention to a passage door on the interior of a building. For reference purposes, the outward portion of the door is referred to as an "exterior surface" and the inward portion (adjacent the hinge pins) is referred to an an "interior surface".

Figure 2:
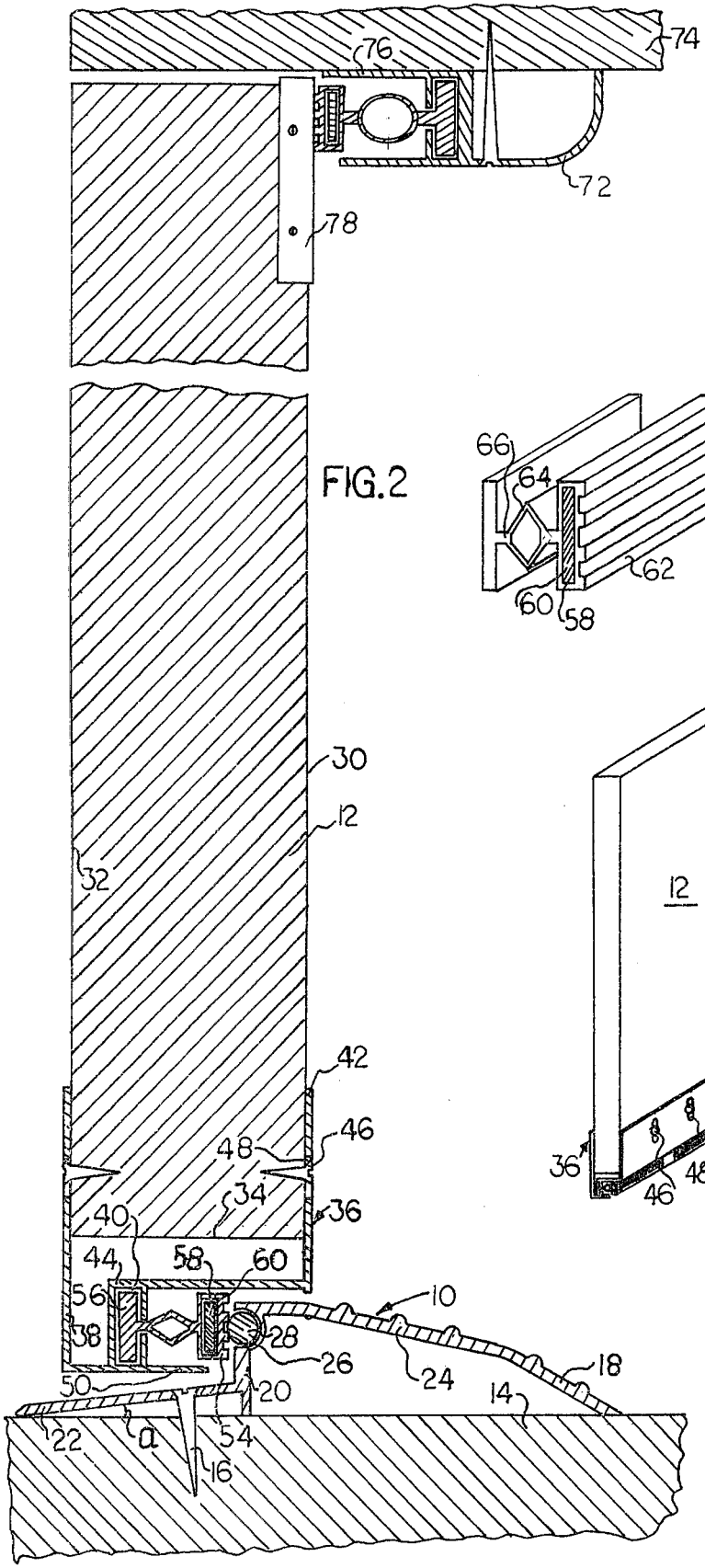
FIG. 2 is a cross-sectional elevation showing the components of a threshold assembly.
Figure 1:
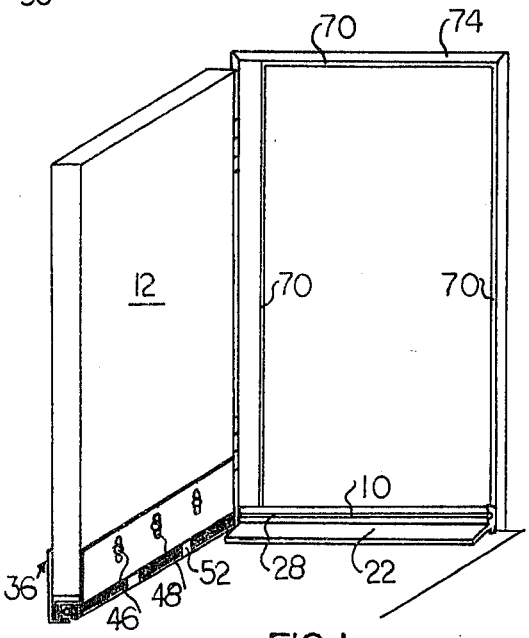
FIG. 1 is a perspective view of a door housing a magnetic-sealing device for threshold.

Referring now to the drawings, the invention is shown generally in FIG. 1 and in more detail in FIG. 2. The lower fragmentary portion of FIG. 2 illustrates the portion of the threshold assembly or the threshold plate installed on the door sill and is referred to generally as 10.

The bottom edge of the door 12 is positioned above a door sill 14. A door sill 14 has affixed thereto by means of screws 16 or the like a stationary threshold plate 18 formed of nonmagnetically attracted material. This plate has a stepped portion with a riser portion 20 which is substantially vertical and which extends medially along the bottom edge of the door 12. A stair portion 22 is substantially horizontal and extends from the lower edge of the riser portion 20. A saddle portion 24 is constructed so as to extend from the upper edge of the riser 20 to the sill 14. The riser portion 20 has an internal channel 26 for receiving a magnetically attracted strip 28. The stair portion 22 and door sill 14 are structured to have a small angle a. therebetween, which angle allows for easy opening of the door. The small angle results in a threshold with a low silhouette thereby reducing tripping of people gaining access to and from the wall opening. The door 12 is positioned above the threshold assembly 10, with an exterior surface 30, an interior surface 32 and the bottom edge 34.

A door cap assembly 36 for mounting on the bottom edge of the door includes a stepped portion on the bottom edge of the door. This portion has a lowermost portion 38 corresponding to stair portion 22 and a uppermost portion 42 corresponding to the saddle portion 24. An exterior facing plate of uppermost portion 42 extends along the bottom edge of the exterior surface 30 of the door. The door cap device extends horizontally and is formed integrally with a magnet-mounting device 44 and the stepped portion and the exterior facing plate 42. The cap device is affixed to the door by means of screws 46 that are inserted in elongated slots 48. A magnet-mounting device is attached to the lowermost portion of the door's stepped portion and is constructed to include a slot 40 which extends substantially vertically adjacent lowermost portion 38. A guard plate 50 extends substantially horizontally adjacent the stair portion 22.

Figure 3:
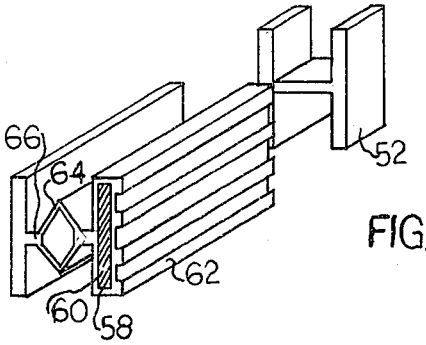
FIG. 3 is a perspective view of a magnet holding assembly.

The door cap device 36 as illustrated in FIG. 1 and the detail thereof in FIG. 3 may be constructed to include vertical stiffening members 52 so as to prevent inadvertent crimping of the guard plate 50.

A magnet holding assembly 54 has a T-shaped mounting flange 56 snugly received in slot 40 extending in spaced relationship to the mounting flange is pocket 58 receiving an elongated magnet 60. The exterior face of pocket 58 (see FIG. 3) has rib members 62 extending longitudinally for facilitating disengagement of magnetic sealing during opening of the door.

An extensible bellows 64 is attached at the one end to a stem 66 and at the other end to the pocket 58 and permits the horizontally extending movement of the magnet assembly when magnetic attraction exists and the horizontally retraction movement of the magnet assembly when magnetic attraction ceases.

When the door is closed, the magnetic attraction of the magnet 60 will cause the extensible bellows 64 to extend transversely to allow the magnet to seal tightly along its fill length upon the open surface of the magnetically attracted strip 28 thus effecting a weather-proof and dust-proof seal.

The sealing construction generally referred to as 70, in the upper portion of the door 12, FIG. 2, differs in several respects from that previously described. A plate 72 is firmly attached to the door frame 74. A weather strip mounting means 76 secures the magnetic sealing means to bridge any gap door 12 and the frame 74. The door is provided about its side and top edges with an insert 78, of steel to form an attracting surface for the magnet of assembly 70.

Although the present invention has been described with reference to particular embodiments and examples it will be apparent to those skilled in the art that variations and modifications can be substituted therefor without deporting from principles and true spirit of the invention. The "Abstract" given above is for the convenience of technical searchers and is not to be used for interpreting the scope of the invention of claims.

What is claimed is:

1. A threshold assembly for mounting on a door and a door sill comprising:

a. a threshold plate formed of non-magnetically attracted material, said plate having a first stepped portion thereof with the substantially vertical face extending medially along the bottom edge of said door:

b. said first stepped portion, in turn comprising:
(1) a riser portion;
(2) a stair portion extending from the lower edge of said portion inwardly toward and beyond the interior surface of said door;
(3) a channel in the face of said riser portion;
(4) a magnetically attracted strip mounted in said channel;

c. a saddle portion extending from the upper edge of said riser portion outwardly beyond the exterior surface of said door;

d. attachment means for attaching said threshold plate to said door sill;

e. a second stepped portion on the bottom edge of said door having the lowermost portion thereof corresponding to said stair portion of said first stepped portion and the uppermost portion thereof corresponding to said saddle portion;

f. magnet-mounting means for attachment to said lowermost portion of said second stepped portion, said magnet-mounting means, in turn comprising;
(1) a slot extending substantially vertically adjacent said lowermost portion;
(2) a guard plate extending substantially horizontally adjacent said stair portion;

g. magnet holding assembly mountable to said magnet-mounting means, in turn comprising:
(1) a T-shaped mounted flange for mounting within said slot thereof with the stem protruding therefrom.
(2) an extensible bellows attached at one end to said stem permitting the horizontally extending movement of the magnet assembly when magnet attraction exists and the horizontally retracting movement of the magnet assembly when magnet attraction ceases;
(3) a pocket with one side thereof attached at the other end of said extensible bellows; and,
(4) a magnet strip mounted in said pocket.

2. A threshold assembly as described in claim 1, wherein said lowermost portion of said second stepped portion is integrally formed with said magnet-mounting means and is mounted to the bottom edge of the interior surface of said door.

3. A threshold assembly as described in claim 4, wherein a door cap assembly for mounting on the bottom edge of said door, comprises:

a. an exterior facing plate extending along the bottom edge of the exterior surface of said door, and b. door cap means extending horizontally and integrally formed with said magnet-mounting means and said second stepped portion.

4. A threshold assembly as described in claim 1 wherein said magnet-holding assembly comprises a vinyl extrusion which integrally forms said T-shaped mounting flange, said extensible bellows and said pocket.

5. A threshold assembly as described in claim 2 wherein the exterior face of said pocket opposite the side attached to said bellows has rib members extending longitudinally for facilitating disengagement of magnetic sealing during opening of the door.

6. A threshold assembly as described in claim 3 wherein said door cap means further includes vertical stiffening members to prevent inadvertent crimping of said guard plate.

7. A threshold assembly for mounting on a door and a door sill comprising:

a. a threshold plate formed of nonmagnetically attracted material, said plate having a first stepped portion thereof with the substantially vertical face extending medially along the bottom edge of said door;

b. said first stepped portion, in turn, comprising:
(1) a riser portion;
(2) a stair portion extending from the lower edge of said riser portion inwardly toward and beyond the interior surface of said door;
(3) a channel in the face of said riser channel;
(4) a magnetically attracted strip mounted in said channel.

c. a saddle portion extending from the upper edge of said riser portion outwardly beyond the exterior surface of said door;

d. attachment means for attaching said threshold plate to said door sill.

e. a door cap assembly for mounting on the bottom edge of said door, in turn, comprising:
(1) a second stepped portion on the bottom edge of said door having the lowermost portion thereof corresponding to said stair portion of said first stepped portion and the uppermost portion thereof corresponding to said saddle portion;
(2) an exterior facing plate extending along the bottom edge of the exterior surface of said door;
(3) door cap means extending horizontally and integrally formed with said second stepped portion and said exterior facing plate;

f. magnet-mounting means for attachment to said lowermost portion of said second stepped portion, said magnet-mounting means, in turn, comprising:
(1) a slot extending substantially vertically adjacent said lowermost portion;
(2) a guard plate extending substantially horizontally adjacent said stair portion;

g. magnet holding assembly mountable to said magnet-mounting means, in turn, comprising:
(1) a T-shaped mounting flange for mounting within said slot thereof with the stem protruding therefrom:
(2) an extensible bellows attached at one end to said stem permitting the horizontally extending movement of the magnet assembly when magnetic attraction ceases;
(3) a pocket with one side thereof attached at the other end of said extensible bellows;
(4) a magnet strip mounted in said pocket.

8. A threshold assembly as described in claim 7 wherein said magnet-holding assembly comprises a vinyl extrusion which integrally forms said T-shaped mounted flange, said extensible bellows and said pocket.

9. A threshold assembly as described in claim 8 wherein the exterior face of said pocket opposite the side attached to said bellows has rib members extending longitudinally for facilitating disengagement of magnet sealing during opening of the door.

10. A threshold assembly as described in claim 7 wherein said door cap means further includes vertical stiffening members to prevent inadvertent crimping of said guard plate.

* * * * *